US009370230B1

(12) United States Patent
So

(10) Patent No.: US 9,370,230 B1
(45) Date of Patent: Jun. 21, 2016

(54) WATERPROOF ELECTRONIC DEVICE HOLDER HAVING ROTATING AND HINGED LOCK

(71) Applicant: Kar Ming So, Kowloon (HK)

(72) Inventor: Kar Ming So, Kowloon (HK)

( * ) Notice: Subject to any disclaimer, the term of this patent is extended or adjusted under 35 U.S.C. 154(b) by 36 days.

(21) Appl. No.: 14/272,688

(22) Filed: May 8, 2014

(51) Int. Cl.
*B65D 85/00* (2006.01)
*A45C 11/00* (2006.01)

(52) U.S. Cl.
CPC ..... *A45C 11/00* (2013.01); *A45C 2011/002* (2013.01)

(58) Field of Classification Search
CPC .. A45C 11/00; A45C 11/22; A45C 2011/002; Y10T 292/426; Y10T 292/385
USPC ..... 206/701, 316.2, 324, 811, 305, 1.5, 206/320; 455/575.1, 575.8; 361/686, 681, 361/679.01, 679.02; 220/259.3–259.4, 692
See application file for complete search history.

(56) References Cited

U.S. PATENT DOCUMENTS 1,468,742 A * 9/1923 Peckes ..... 206/90
1,532,614 A * 4/1925 Waibel ..... 224/577
4,097,878 A * 6/1978 Cramer ..... 396/27
6,003,831 A * 12/1999 Coleman ..... 248/688
6,092,707 A * 7/2000 Bowes, Jr. ..... 224/435
7,464,814 B2 * 12/2008 Carnevali ..... 206/320
7,594,576 B2 * 9/2009 Chen et al. ..... 206/320
8,251,408 B2 * 8/2012 Chen et al. ..... 292/80
2003/0196917 A1 * 10/2003 Broadhead ..... 206/308.2
2008/0029413 A1 * 2/2008 Brandenburg ..... 206/320

* cited by examiner

*Primary Examiner* — Chun Cheung
(74) *Attorney, Agent, or Firm* — Nicholas Pfeifer; Ronald E. Smith; Smith and Hopen, P.A.

(57) ABSTRACT

A holder for an electronic device includes a housing having a base, a cover and a rotatable lock that collectively define a hollow interior that receives the electronic device. The rotatable lock is hingedly connected to the base at a first end of the housing and is also rotatably mounted with respect to a lid that closes the hollow interior. An electronic device is slideable into and out of the hollow interior when the rotatable lock is unlocked and the lid is open. A hingedly mounted lock has a locked configuration that prevents rotation of the rotatable lock relative to the lid. The locked configuration of the rotatably mounted lock also prevents hinged opening of the lid. The rotatable lock has an unlocked configuration that enables rotation of the rotatable lock relative to the lid. The unlocked configuration enables hinged opening of the rotatable lock and the lid.

15 Claims, 8 Drawing Sheets

WATERPROOF ELECTRONIC DEVICE HOLDER HAVING ROTATING AND HINGED LOCK

BACKGROUND OF THE INVENTION

1. Field of the Invention

This invention relates, generally, to waterproof holders for electronic devices such as smart phones. More particularly, it relates to a waterproof holder that has two locks.

2. Description of the Prior Art

U.S. Pat. No. 8,453,835 to the Kar Ming So discloses a waterproof electronic device holder that is tightly closed against water intrusion by a unique rotating lock. Said patent is hereby incorporated into this disclosure by reference and is referred to hereinafter as the incorporated patent.

The holder has a shape that conforms to the electronic device it holds such as a smart phone, i.e., it is generally rectangular and its thickness only slightly exceeds that of the device it holds. A cover of the holder frames a transparent plastic or other suitable material that closely overlies the screen of the electronic device that displays various icons so that the device can be operated by touching the icons through the material that overlies the screen.

The rotating lock cannot be rotated until a hingedly mounted locking member is lifted to allow such rotation. After that locking member is lifted, the rotatably mounted locking apparatus is rotated one hundred eighty degrees (180°) about a central pivot point to unlock the holder so that the device can be removed therefrom. The rotating lock is positioned at a first transverse end or top of the holder and the hinge that allows opening of the device is positioned at a second transverse end or bottom of the holder. Accordingly, the cover pivots about the hinge and swings away from a base of the holder so that the cover and base remain connected to one another only at the transverse hinge. When the device is returned to the holder, it overlies the base of the holder and the cover is pivoted about the transverse hinge until it overlies the base. The rotating lock is then rotated one hundred eighty degrees (180°) in a direction opposite to its unlocking direction and the hingedly mounted locking member is lowered to complete the locking procedure.

The device disclosed in the incorporated patent works well. However, the device opens and closes something like a clam shell, i.e., the cover and base are hingedly connected to one another at one end of the device. Accordingly, when the cover is swung away from the base, the longitudinally extending edges of the cover and base are separated from one another, thereby breaking the seal between them. That seal is re-established when the holder is closed and locked, but such seal can wear over time with repeated opening and closing.

An improved holder would retain the highly effective rotatable lock but would also retain the longitudinally-extending seal between the cover and base when the holder is opened in order to remove a device therefrom or to insert a device thereinto.

However, in view of the art considered as a whole at the time the present invention was made, it was not obvious to those of ordinary skill in the art how the improved holder could be provided.

SUMMARY OF THE INVENTION

The long-standing but heretofore unfulfilled need for a waterproof electronic device holder is now provided by a new, useful, and non-obvious invention.

The novel holder includes a generally rectangular housing having a base, a cover and a lid that collectively define a hollow interior adapted to hold an electronic device. When the lid is open, the device is inserted into or retracted from the hollow interior through the opening and therefore there is no clam shell-like opening and closing of the base and cover.

The base includes a back wall, a pair of longitudinally disposed sidewalls and a pair of transversely disposed end walls. The cover includes a front wall, a pair of longitudinally disposed sidewalls and a pair of transversely disposed end walls. The cover includes a transparent sheet material framed by the front wall and adapted to be disposed in overlying relation to a screen of an electronic device when the electronic device is disposed within the hollow interior of the housing.

The lid is hingedly mounted to the base at a first end of the housing and has an open configuration and a closed configuration. An electronic device is slideable into and out of the hollow interior of the housing when the lid is in its open configuration and the electronic device is retained within the hollow interior when the lid is in its closed configuration.

A rotatably mounted lock is rotatably connected to the lid, mid-length thereof. The rotatably mounted lock has a locked configuration that prevents rotation of the rotatably mounted lock relative to the lid. The locked configuration of the rotatably mounted lock also prevents hinged opening of the lid. The rotatably mounted lock has an unlocked configuration that enables rotation of the rotatably mounted lock relative to the lid. The unlocked configuration of the rotatably mounted lock also enables hinged opening of the lid.

The housing is adapted to slidingly receive an electronic device within its hollow interior when the rotatably mounted lock is in the unlocked configuration and the lid is in its open configuration.

The housing is adapted to maintain an electronic device within the hollow interior when the rotatably mounted lock and the lid are in their respectively locked configurations.

A latch is mounted to or integrally formed with a transversely disposed end wall of the cover at the first end of the housing, mid-length of the transversely disposed end wall and a catch is formed in the rotatably mounted lock, mid-length thereof. The latch and catch are engaged to and disengaged from one another in substantially the same way as disclosed in the incorporated patent.

The latch is disposed in engaging relation to the catch when the rotatably mounted lock is in its locked configuration, thereby preventing opening of the rotatably mounted lock about the hinge.

An opening is formed in the rotatably mounted lock to accommodate the latch. The opening is disposed in open communication with the latch when the rotatably mounted lock is in its unlocked configuration, thereby enabling opening of the rotatably mounted lock about the hinge. The opening is misaligned relative to the latch when the rotatably mounted lock is in its locked configuration, thereby preventing opening of the rotatably mounted lock about the hinge.

A hingedly mounted locking member is secured to an outboard end of the rotatably mounted lock and a recess is formed in a preselected sidewall of the housing that captures that hingedly mounted locking member when it is in a deployed, locked configuration. The rotatably mounted lock is held against rotation when the hingedly mounted locking member is positioned within the recess and the rotatably mounted lock is free to rotate relative to the lid when the hingedly mounted locking member is pivoted away from the recess.

The hinge mechanism that enables opening and closing of the lid when the rotatably mounted lock is rotated into its unlocked configuration includes a first transversely disposed bore formed in the first end of the base and which extends a predetermined distance in an inboard direction from a first sidewall of the base and a second transversely disposed bore formed in the first end of the base that extends a predetermined distance in an inboard direction from a second sidewall of the base.

A hinge pin has opposite ends disposed within the first and second transversely disposed bores and the rotatable lock is hingedly mounted to the hinge pin, rotatably engaging it along a medial extent thereof that is inboard of the first and second transversely disposed bores.

A resilient pad is secured to an interior surface of the lid and is adapted to push down on the upper end of the electronic device disposed within the hollow interior of the housing when the lid is closed.

A pair of transversely spaced apart resilient pads are positioned in the hollow interior of the housing at the second end thereof. The lower end of the electronic device occupying the hollow interior is urged against that pair of transversely spaced apart resilient pads when the pad secured to the interior surface of the lid is pushed down on the upper end of the electronic device as the lid is closed.

A sealing gasket member circumscribes the lid and is disposed within the hollow interior of the housing near the first end of the housing when the lid is closed.

An important object of the invention is to provide a housing for an electronic device that has a double locking means to prevent inadvertent unlocking and to enhance the waterproof or water-resistant qualities of the holder.

Another important object is to provide a housing that opens only at one end thereof so that the base and cover of the device are not separated from one another when the device is opened and closed to enable insertion and removal of an electronic device thereinto or therefrom, respectively.

These and other objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1B:
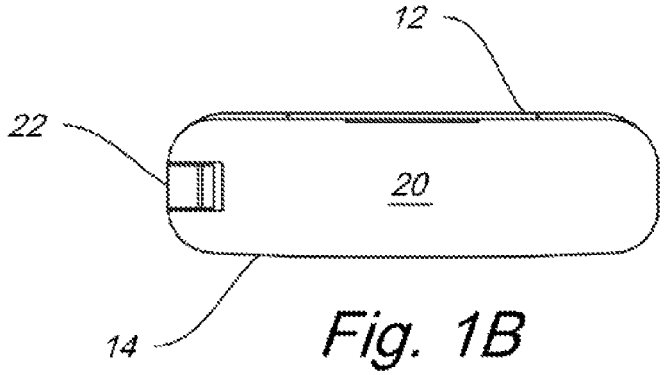
FIG. 1B is a top plan view of the structure depicted in FIG. 1A.
Figure 1A:
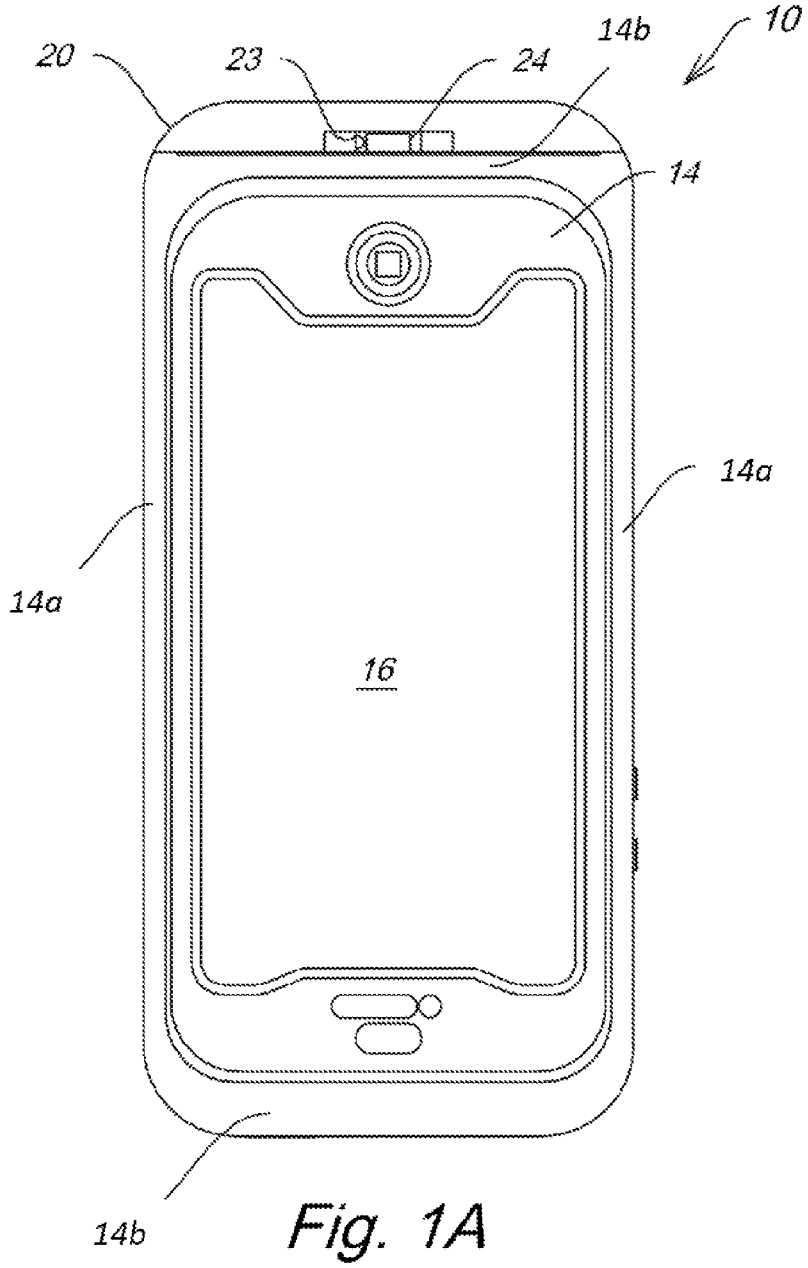
FIG. 1A is a front elevation view of the novel structure when in its locked configuration.

FIGS. 1A and 1B depict an illustrative embodiment of the novel structure which is denoted as a whole by the reference numeral 10. The base of housing 10 is denoted 12 and the top or cover of the housing is denoted 14. Transparent sheet material 16 is framed by the front wall of cover 14 and overlies the screen of the electronic device held within housing 10.

Figure 7:
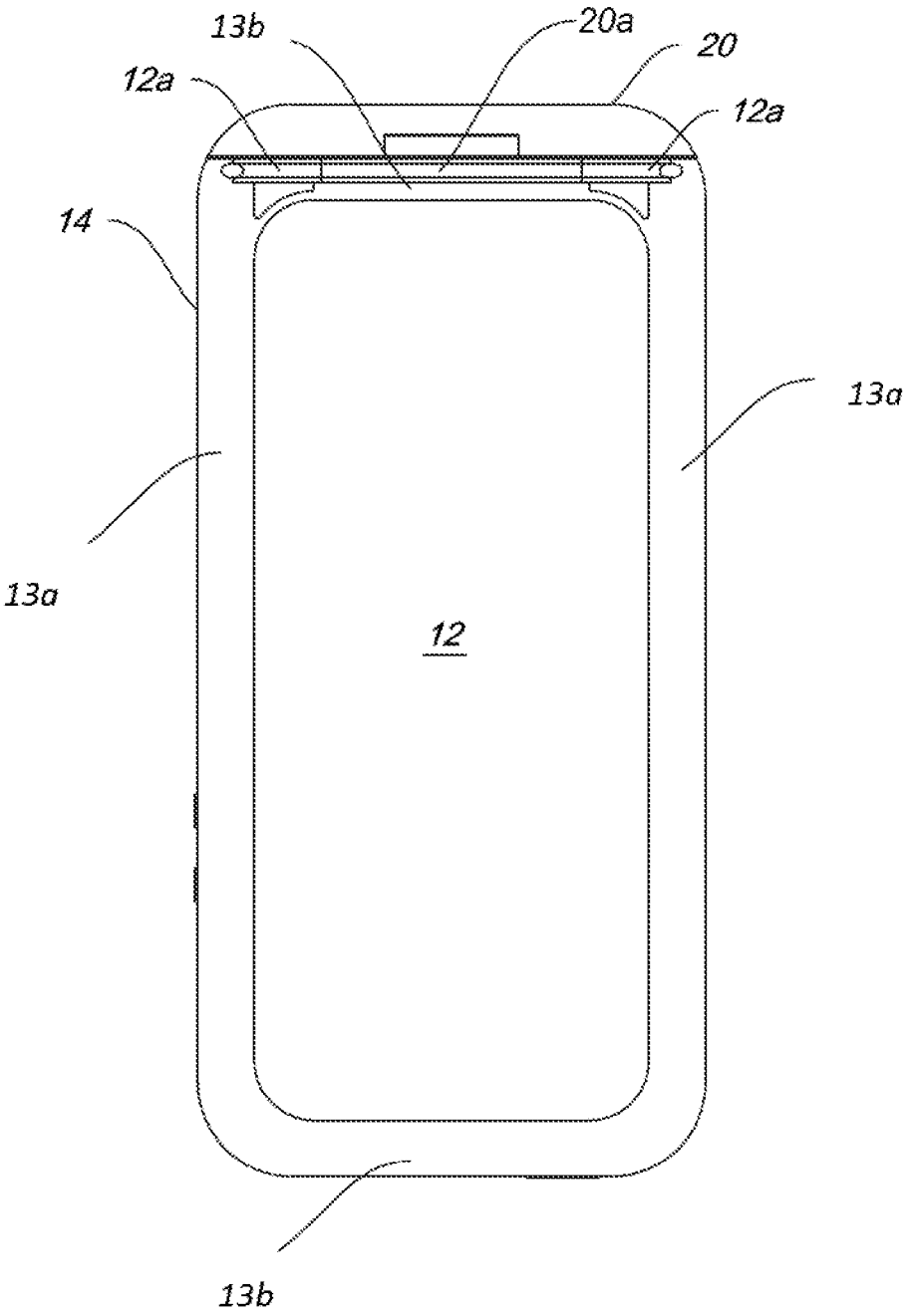
FIG. 7 is a rear elevation view of the device when in its closed configuration.

Base 12 includes a pair of longitudinally disposed sidewalls collectively denoted by reference numeral 13*a* and a pair of transversely disposed end walls denoted by reference numeral 13*b*, which is depicted in FIG. 7. Cover 14 includes a pair of longitudinally disposed sidewalls collectively denoted by reference numeral 14*a* and a pair of transversely disposed end walls collectively denoted by reference numeral 14*b*, as depicted in FIG. 1.

Figure 5B:
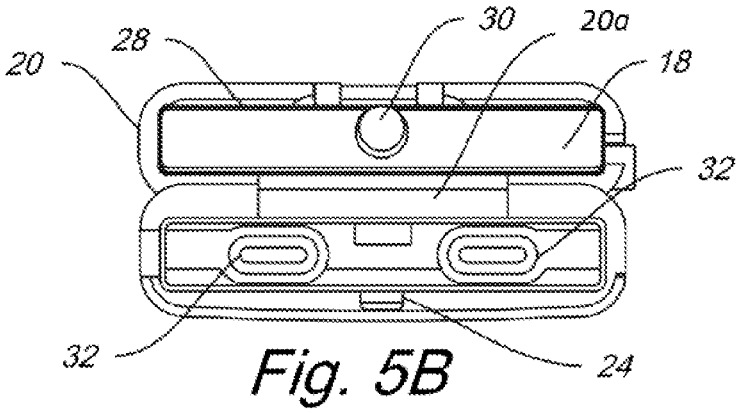
FIG. 5B is a top plan view of the structure depicted in FIG. 5A.
Figure 5A:
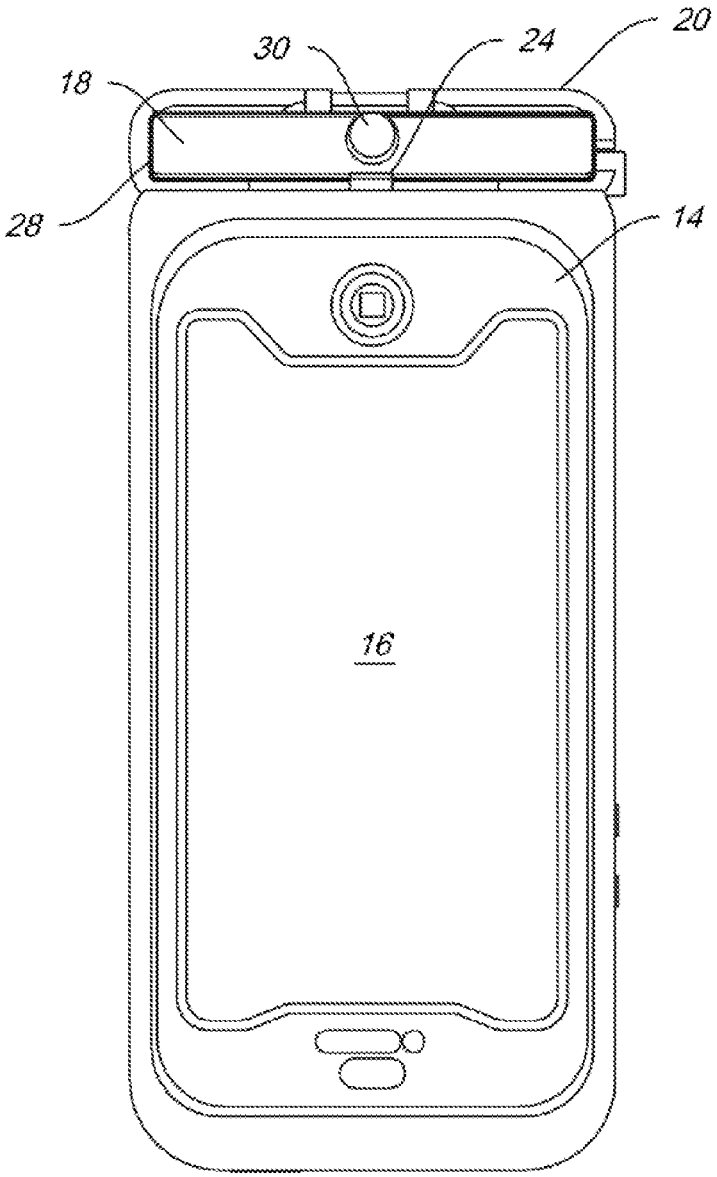
FIG. 5A is a front elevation view similar to that of FIG. 4A, but with the lid of the novel structure in its open configuration.
Figure 6A:
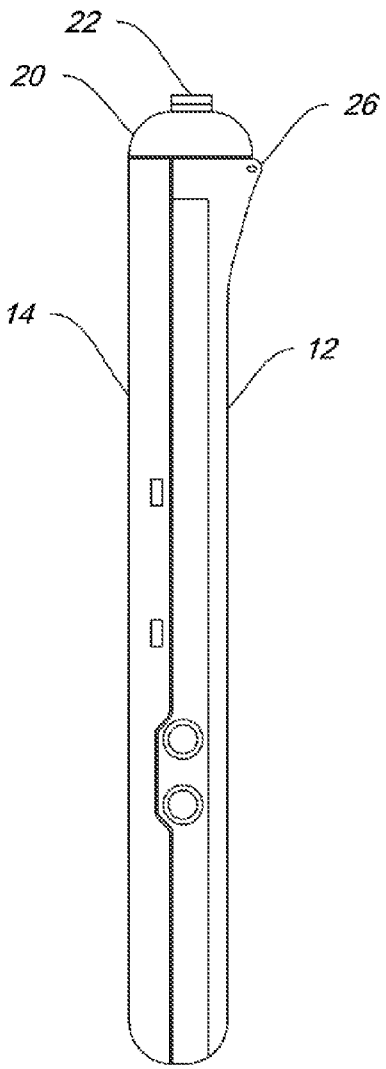
FIG. 6A is a side elevation view of the structure depicted in FIG. 2A.
Figure 6B:
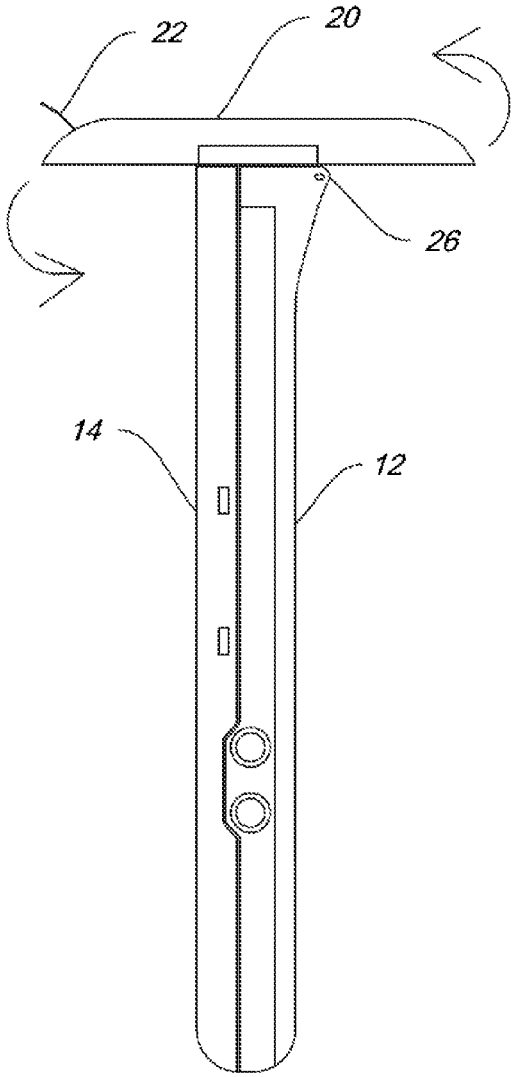
FIG. 6B is a side elevation of the structure depicted in FIG. 3A.
Figure 6C:
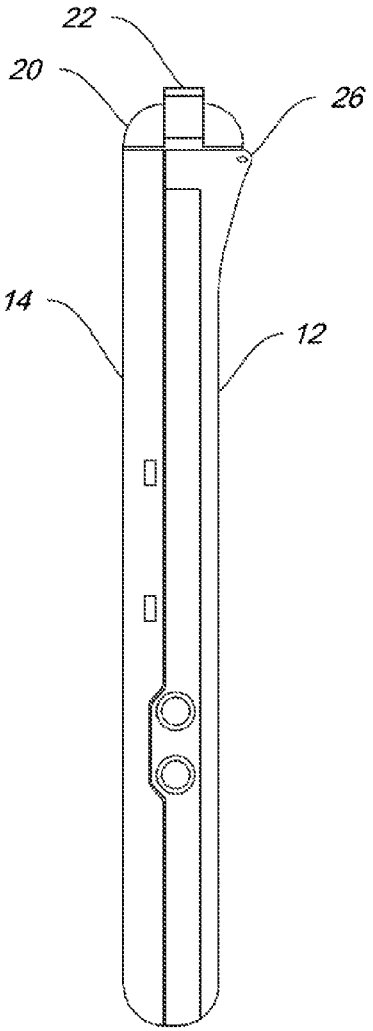
FIG. 6C is a side elevation view of the structure depicted in FIG. 4A.
Figure 6D:
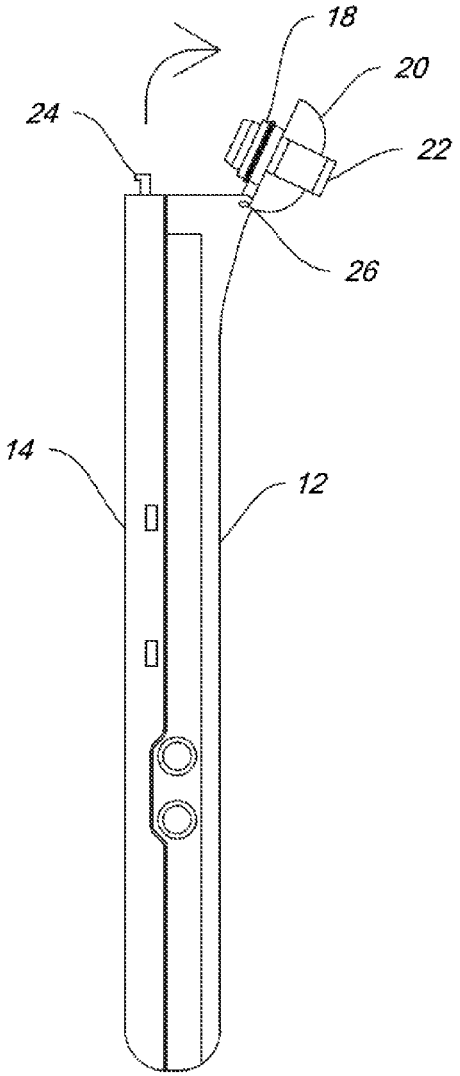
FIG. 6D is a side elevation of the structure depicted in FIG. 5A.

Lid 18, depicted in FIGS. 5A, 5B, and FIG. 6D, is hingedly connected to base 12 and rotatable lock 20 is rotatably mounted to lid 18. The device is fully locked in said FIGS. 1A and 1B, i.e., when the novel apparatus is in its FIG. 1A, FIG. 1B position, lid 18 is fully received within the hollow interior of holder 10 and rotatable lock 20 is in its locked configuration. Hingedly mounted locking member 22, when in its fully closed and locked position as depicted in FIGS. 1A and 1B, prevents rotation of rotatable lock 20 because said member 22 is positioned within a recess formed in a sidewall of housing 10.

Cut-away or opening 23 is formed in rotatable lock 20 to accommodate latch 24. Latch 24 is formed integrally with cover 14 at its first, upper end or it may be formed integrally with a liner that follows the contour of the interior of cover 14, said liner being formed integrally with base 12 and circumscribing the interior upper rim of holder 10 as more fully disclosed hereinafter.

Figure 2B:
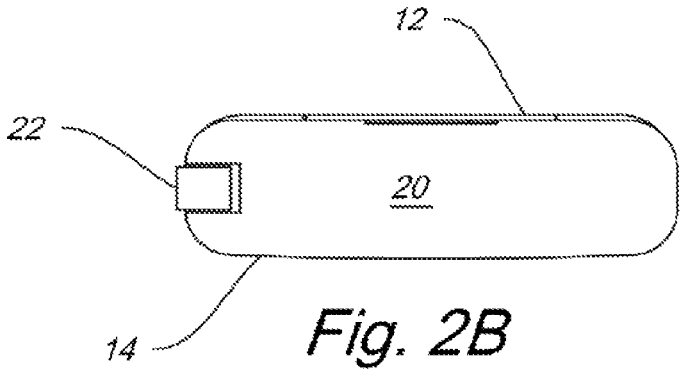
FIG. 2B is a top plan view of the structure depicted in FIG. 2A.
Figure 2A:
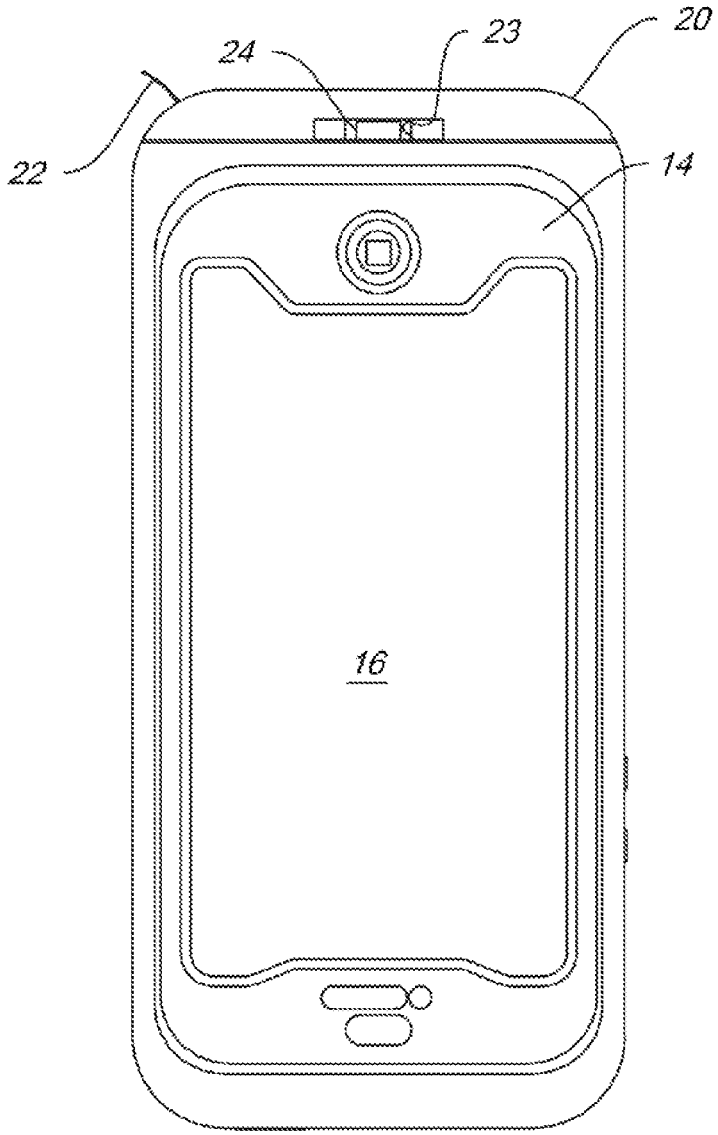
FIG. 2A is a front elevation view when the hinged locking member is lifted to allow rotation of the rotatable lock.

FIGS. 2A and 2B are the same as FIGS. 1A and 1B with the exception that hingedly mounted locking member 22 is lifted and rotatable lock 20 is free to be rotated. The structure depicted in FIG. 2A is depicted in FIG. 6A in side elevation.

Figure 3B:
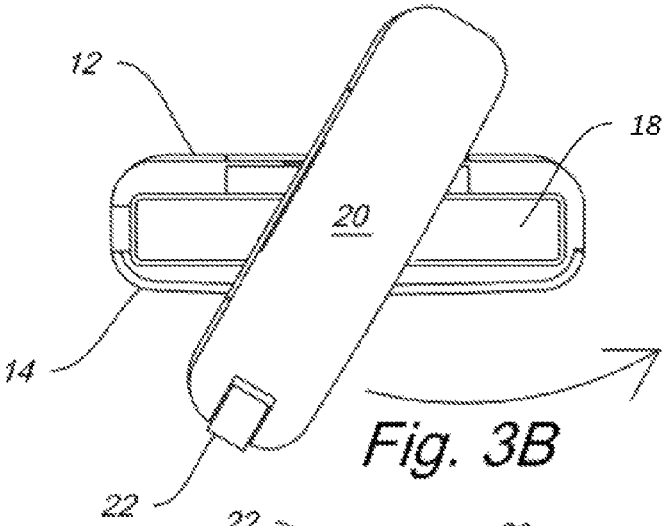
FIG. 3B is a top plan view depicting the rotatable lock being rotated toward its FIG. 3A position.
Figure 3A:
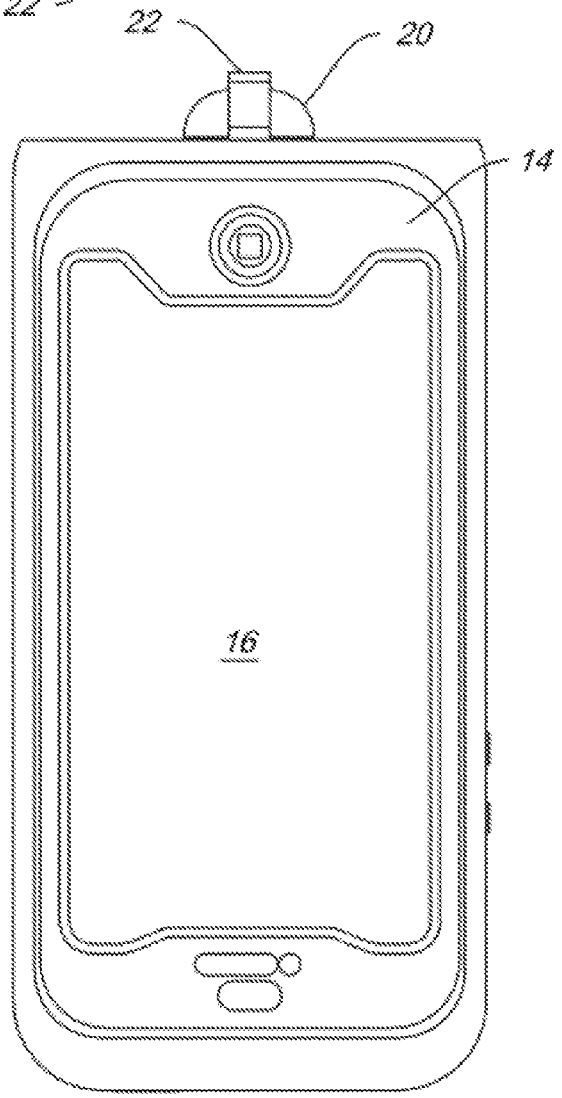
FIG. 3A is a front elevation view after the rotatable lock is rotated ninety degrees (90°) relative to its FIG. 2A position.

FIG. 3A is the same as FIG. 2A with the exception that rotatable lock 20 has been rotated ninety degrees (90°) from its FIG. 2A position. FIG. 3B is a top view depicting said rotatable lock 20 in the process of being rotated as indicated by the un-numbered directional arrow. The structure depicted in FIG. 3A is depicted in FIG. 6B in side elevation.

Figure 4B:
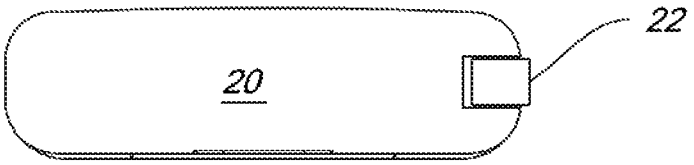
FIG. 4B is a top plan view of the structure depicted in FIG. 4A.
Figure 4A:
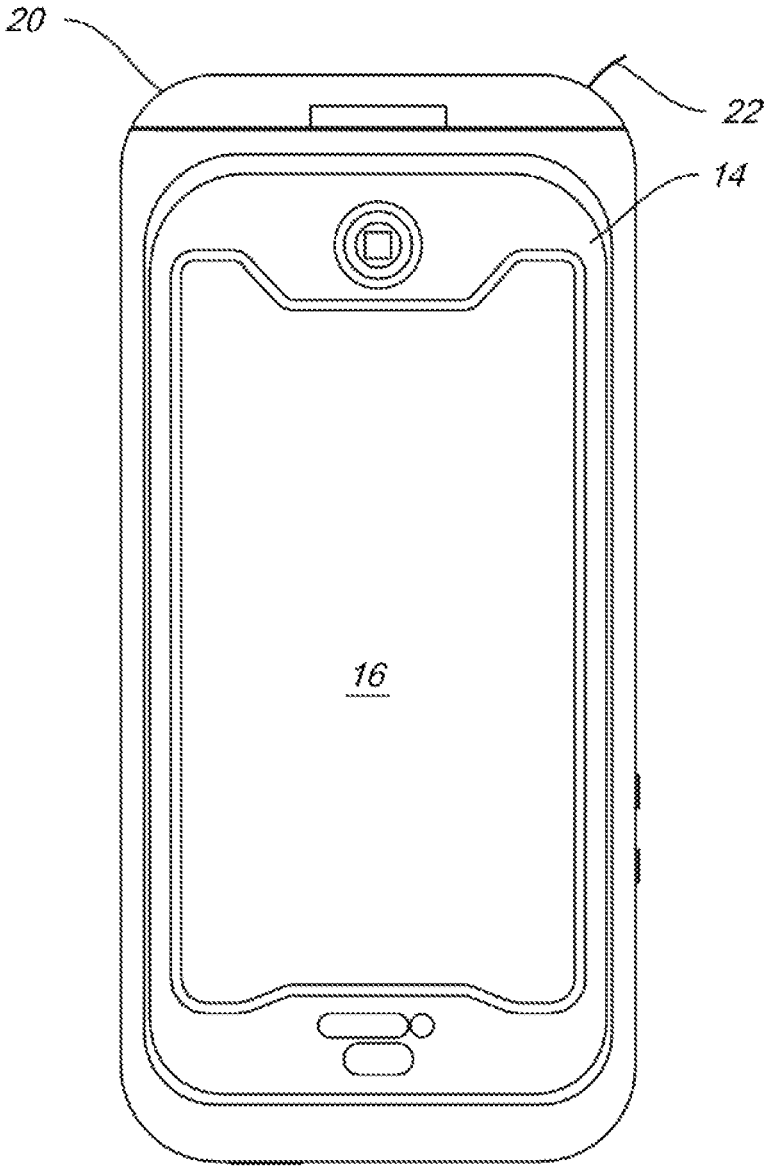
FIG. 4A is a front elevation view after the rotatable lock is rotated one hundred eighty degrees (180°) relative to its FIG. 2A position.

FIGS. 4A and 4B depict lock 20 rotated one hundred eighty degrees (180°) from its FIG. 2A position. Lock 20 when so rotated no longer engages latch 24. The structure depicted in FIG. 4A is depicted in FIG. 6C in side elevation.

FIG. 5A is the same as FIG. 4A but with lid 18 and hence rotatable lock 20 being rotated about hinge pin 26 about one hundred thirty five degrees (135°) relative to the FIG. 4A position. An electronic device, not depicted, may be inserted into the hollow interior of container 10, or withdrawn therefrom, because lid 18 and rotatable lock 20 are in their open configuration. The structure depicted in FIG. 5A is depicted in FIG. 6*d* in side elevation.

FIG. 5B is a top plan view of housing 10 when lid 18 and rotatable lock 20 are rotated about hinge pin 26 about one hundred thirty five degrees (135°) relative to the FIG. 4A position.

A groove is formed about the periphery of lid 18 and waterproof or resistant sealing member or gasket 28 is positioned within said groove.

Pad 30 is formed of a hard rubber or other suitable flexible and resilient elastomeric material and is riveted or otherwise secured to an interior surface of lid 18. Pad 30 performs the function of pushing down on the electronic device housed within device 10 when lid 18 is closed. A pair of transversely spaced apart pads, denoted 32, 32 in FIG. 6, are formed of the same or similar material and are positioned in the interior of housing 10 at its bottom end as depicted in FIG. 5B. The top of the electronic device is therefore urged against said bottom pads 32, 32 when pad 30 urges against the bottom of the electronic device when lid 18 is closed.

Rotation of rotatable lock from its locked FIG. 2A position to its unlocked FIG. 4A position releases latch 24 and enables hinged rotation of lid 18 and rotatable lock 20 about hinge pin 26. There is no hinge pin 26 in the incorporated patent but the structure disclosed in said incorporated patent for locking and unlocking rotatable lock 20 is incorporated into the present invention.

In FIGS. 1A, 2A, 3A, and 4A, lid 18 and gasket 28 are fully received within the hollow interior of holder 10.

As mentioned above, FIG. 6A is a side elevation view of the structure depicted in FIG. 2A, FIG. 6B is a side elevation of the structure depicted in FIG. 3A, FIG. 6C is a side elevation view of the structure depicted in FIG. 4A, and FIG. 6D is a side elevation of the structure depicted in FIG. 5A.

FIG. 7 is a rear elevation view of the device when said device is in its FIG. 1A, 1B configuration. Opposite ends of transversely disposed hinge pin 26 are housed within a pair of transversely spaced apart, transversely disposed bores 12*a*, 12*b* formed in the first or upper end of base 12. More particularly, each of said transversely disposed bores extends in an inboard direction from a sidewall of housing 10 for a predetermined extent. As depicted in FIGS. 6A-6D, the upper end of base 12 is enlarged relative to its unenlarged thickness in the incorporated patent.

The medial extent of hinge post 28, i.e., the extent thereof not disposed within transverse bores 12*a*, 12*a*, is engaged by cylindrical hinge pin engaging member 20*a* that is formed integrally with rotatable locking member 20.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A holder for an electronic device, comprising:

a generally rectangular housing having a base, a cover and a lid that collectively define a hollow interior adapted to hold an electronic device;

said base including a back wall, a pair of longitudinally disposed sidewalls and a pair of transversely disposed end walls;

said cover including a front wall, a pair of longitudinally disposed sidewalls and a pair of transversely disposed end walls;

said front wall including a transparent sheet material framed by said cover and adapted to be disposed in overlying relation to a screen of an electronic device when an electronic device is disposed within said hollow interior;

said lid hingedly mounted to said base at a first end of said housing;

a rotatable lock rotatably mounted to said lid;

said lid having a hingedly open configuration and a hingedly closed configuration, wherein said hingedly open configuration allows an electronic device to slide into and out of said hollow interior and said hingedly closed configuration retains an electronic device within said hollow interior;

said rotatable lock having a locked configuration that prevents rotation of said rotatable lock relative to said lid and relative to said housing;

said locked configuration of said rotatable lock also preventing hinged opening of said lid; and said rotatable lock having an unlocked configuration that enables rotation of said rotatable lock relative to said lid and said rotation of said rotatable lock relative to said lid allowing said lid to hingedly open.

2. The holder of claim 1, further comprising:

a latch mounted to a transversely disposed end wall of said cover at said first end of said housing, mid-length of said transversely disposed end wall;

a catch formed in said rotatable lock, mid-length of said rotatable lock;

said latch disposed in engaging relation to said catch when said rotatable lock is in said locked configuration, thereby preventing opening of said rotatable lock and said lid about said hinge.

3. The housing of claim 2, further comprising:

an opening formed in said rotatable lock to accommodate said latch;

said opening disposed in open communication with said latch when said rotatable lock is in said unlocked configuration, thereby enabling opening of said rotatable lock and said lid about said hinge;

said opening misaligned relative to said latch when said rotatable lock is in said locked configuration, thereby preventing opening of said rotatable lock and said lid about said hinge.

4. The holder of claim 3, further comprising:

a hingedly mounted locking member secured to an outboard end of said rotatable lock;

a recess formed in a preselected sidewall of said housing that captures said hingedly mounted locking member when said hingedly mounted locking member is in a deployed, locked configuration;

said rotatable lock being held against rotation when said hingedly mounted locking member is positioned within said recess; and said rotatable lock being free to rotate relative to said lid when said hingedly mounted locking member is pivoted away from said recess.

5. The housing of claim 4, further comprising:

a first transversely disposed bore formed in said first end of said base;

said first transversely disposed bore extending a predetermined distance in an inboard direction from a first sidewall of said base;

a second transversely disposed bore formed in said first end of said base;

said second transversely disposed bore extending a predetermined distance in an inboard direction from a second sidewall of said base;

a hinge pin having opposite ends disposed within said first and second transversely disposed bores;

said lid hingedly mounted to said hinge pin, said lid engaging said hinge post along a medial extent thereof that is external to said first and second transversely disposed bores.

6. The housing of claim 5, further comprising:

a resilient pad secured to an interior surface of said lid;

said pad adapted to push down on an electronic device disposed within the hollow interior of said housing when said lid is closed.

7. The housing of claim 6, further comprising:

a pair of transversely spaced apart resilient pads positioned in said hollow interior of said housing at a second end thereof, said electronic device being urged against said pair of transversely spaced apart resilient pads when said pad secured to said interior surface of said lid is pushed down on said electronic device when said lid is closed.

8. The holder of claim 1, further comprising:

a sealing member that circumscribes said lid;

said sealing member being disposed within said hollow interior near said first end when said lid is closed.

9. A holder for an electronic device, comprising:

a generally rectangular housing having a base, a cover and a lid that collectively define a hollow interior adapted to hold an electronic device;

said base including a back wall, a pair of longitudinally disposed sidewalls and a pair of transversely disposed end walls;

said cover including a front wall, a pair of longitudinally disposed sidewalls and a pair of transversely disposed end walls;

said front wall including a transparent sheet material framed by said cover and adapted to be disposed in overlying relation to a screen of an electronic device when an electronic device is disposed within said hollow interior;

said lid hingedly mounted to said base at a first end of said housing;

a rotatable lock rotatably mounted to said lid;

said lid having a hingedly open configuration and a hingedly closed configuration, wherein said hingedly open configuration allows an electronic device to slide into and out of said hollow interior and said hingedly closed configuration retains an electronic device within said hollow interior;

said rotatable lock having a locked configuration that prevents rotation of said rotatable lock relative to said lid and relative to said housing;

said locked configuration of said rotatable lock also preventing hinged opening of said lid;

said rotatable lock having an unlocked configuration that enables rotation of said rotatable lock relative to said lid and said rotation of said rotatable lock relative to said lid allowing said lid to hingedly open;

a latch mounted to a transversely disposed end wall of said cover at said first end of said housing, mid-length of said transversely disposed end wall;

a catch formed in said rotatable lock, mid-length of said rotatable lock; and said latch disposed in engaging relation to said catch when said rotatable lock is in said locked configuration, thereby preventing opening of said lid about said hinge.

10. The housing of claim 9, further comprising:

an opening formed in said rotatable lock to accommodate said latch;

said opening disposed in open communication with said latch when said rotatable lock is in said unlocked configuration, thereby enabling opening of said rotatable lock and said lid about said hinge;

said opening misaligned relative to said latch when said rotatable lock is in said locked configuration, thereby preventing opening of said rotatable lock and said lid about said hinge.

11. The holder of claim 10, further comprising:

a hingedly mounted locking member secured to an outboard end of said rotatable lock;

a recess formed in a preselected sidewall of said housing that captures said hingedly mounted locking member when said hingedly mounted locking member is in a deployed, locked configuration;

said rotatable lock being held against rotation when said hingedly mounted locking member is positioned within said recess; and said rotatable lock being free to rotate relative to said lid when said hingedly mounted locking member is pivoted away from said recess.

12. The housing of claim 11, further comprising:

a first transversely disposed bore formed in said first end of said base;

said first transversely disposed bore extending a predetermined distance in an inboard direction from a first sidewall of said base;

a second transversely disposed bore formed in said first end of said base;

said second transversely disposed bore extending a predetermined distance in an inboard direction from a second sidewall of said base;

a hinge pin having opposite ends disposed within said first and second transversely disposed bores;

said lid hingedly mounted to said hinge pin, said lid engaging said hinge post along a medial extent thereof that is external to said first and second transversely disposed bores.

13. The housing of claim 12, further comprising:

a resilient pad secured to an interior surface of said lid;

said pad adapted to push down on an electronic device disposed within the hollow interior of said housing when said lid is closed.

14. The housing of claim 13, further comprising:

a pair of transversely spaced apart resilient pads positioned in said hollow interior of said housing at a second end thereof, said electronic device being urged against said pair of transversely spaced apart resilient pads when said pad secured to said interior surface of said lid is pushed down on said electronic device when said lid is closed.

15. The holder of claim 14, further comprising:

a sealing member that circumscribes said lid;

said sealing member being disposed within said hollow interior near said first end when said lid is closed.

* * * * *